US007589691B2

(12) United States Patent
Noro

(10) Patent No.: US 7,589,691 B2
(45) **Date of Patent: *Sep. 15, 2009**

(54) ANTENNA APPARATUS HAVING A SHIELDING WALL BETWEEN AN INPUT UNIT AND AN OUTPUT UNIT OF A CIRCUIT BOARD ON WHICH AN AMPLIFIER CIRCUIT IS PROVIDED

(75) Inventor: Junichi Noro, Akita (JP)

(73) Assignee: Mitsumi Electric Co., Ltd., Tama-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/901,475

(22) Filed: Sep. 17, 2007

(65) Prior Publication Data

US 2008/0068279 A1 Mar. 20, 2008

(30) Foreign Application Priority Data

Sep. 19, 2006 (JP) ..... 2006-252312

(51) Int. Cl.
*H01Q 1/52* (2006.01)

(52) U.S. Cl. ..... 343/841; 343/700 MS

(58) Field of Classification Search ..... 343/700 MS, 343/702, 841

See application file for complete search history.

(56) References Cited

U.S. PATENT DOCUMENTS 5,585,806 A * 12/1996 Ogino et al. ..... 343/700 MS
5,831,577 A * 11/1998 Nichols et al. ..... 342/357.03
6,538,611 B2 * 3/2003 Noro ..... 343/725
6,674,013 B2 * 1/2004 Noro et al. ..... 174/152 G
6,879,294 B2 * 4/2005 Yuanzhu ..... 343/725
7,327,328 B2 * 2/2008 Yoneya et al. ..... 343/841
2008/0068278 A1 * 3/2008 Noro ..... 343/841

FOREIGN PATENT DOCUMENTS

JP 2004-072320 A 3/2004
JP 2004-228357 A 8/2004
JP 2005-110007 A 4/2005

* cited by examiner

*Primary Examiner*—Tan Ho
(74) *Attorney, Agent, or Firm*—Frishauf, Holtz, Goodman & Chick, P.C.

(57) ABSTRACT

Disclosed is an antenna apparatus including an antenna element including a receiving unit to receive an electric wave, a circuit board on which an amplifier circuit to amplify an input signal inputted from the antenna element is formed, and to which an input unit for receiving the input signal from the antenna element and an output unit for an amplified signal are provided, and a shield cover which shields an interfering wave by covering the amplifier circuit on the circuit board and which is grounded, and a shielding wall to shield a crosstalk between the input unit and the output unit is formed between the input unit and the output unit of the circuit board inside the shield cover, and the shielding wall is grounded.

7 Claims, 4 Drawing Sheets

ANTENNA APPARATUS HAVING A SHIELDING WALL BETWEEN AN INPUT UNIT AND AN OUTPUT UNIT OF A CIRCUIT BOARD ON WHICH AN AMPLIFIER CIRCUIT IS PROVIDED

BACKGROUND OF THE INVENTION

1. Field of the Invention

The present invention relates to an antenna apparatus, and more particularly, to an antenna apparatus used for receiving an electric wave for the GPS (Global Positioning System), a satellite radio, or the like.

2. Description of the Related Art

For example, various types of antenna apparatuses are developed as an antenna apparatus for in-car GPS system which is popular as a positioning system and, as an antenna apparatus used for a satellite radio or the like of in-car type or emplacement type for household use or the like which is in practical use in the United States (for example, see JP2005-110007A, JP2004-72320A, and JP2004-228357A).

In such an antenna apparatus, for example, a circuit board 103 is attached on a back surface of an antenna element 102 having a patch-type receiving face 101 which receives the electric wave as in the antenna apparatus 100 which is shown as an example in FIG. 5. An amplifier circuit (omitted from the drawing) to amplify the signal which is input from the antenna element 102 is formed on the opposite surface of the antenna element 102 of the circuit board 103. The surface in which the amplifier circuit is formed is covered with an approximately box-shaped shield cover 104 which shields the extraneous interfering wave. In FIG. 5, the receiving face 101 is expressed thicker than the actual receiving face 101.

The input pin 105 is penetratingly inserted in the antenna element 102 and the circuit board 103 so as to be vertical to the antenna element 102 and the circuit board 103, and one end of the input pin 105 is electrically connected to the receiving face 101 of the antenna element 102 by soldering. The other end of the input pin 105 is soldered to the amplifier circuit on the circuit board 103 and is electrically connected thereto, and an input unit 103*a* is formed there. The input pin 105 inputs the electric wave signal, which is received by the receiving face 101 of the antenna element 102, in the amplifier circuit of the circuit board 103.

Moreover, a coaxial cable 106 is inserted inside the shield cover 104. A core wire 106*a* of the coaxial cable 106 is soldered to the amplifier circuit on the circuit board 103 and is electrically connected thereto, and the connected portion composes an output unit 103*b* of the amplifier circuit. The coaxial cable 106 supplies the driving power to the amplifier circuit via the core wire 106*a*, and outputs the signal which is received by the antenna element 102 and amplified by the amplifier circuit.

Furthermore, the shield cover 104 assumes the function of the GND, and the shield cover 104 is to have the GND potential via the tongue 104*b* due to the tongue 104*b*, which is formed by being bent in the coaxial cable 106 side from the basal face 104*a* of the shield cover 104, being soldered and electrically connected to an external conductor 106*b* of the coaxial cable 106. Accordingly, the amplifier circuit is to be grounded via the shield cover 104.

In recent years, downsizing of such antenna apparatus is being attempted. When the apparatus is downsized, the input unit 103*a* and the output unit 103*b* of the amplifier circuit of the circuit board 103 approximate one another. When the input unit 103*a* and the output unit 103*b* approximate one another as described above, an isolation of the signal input/output is degraded and there is a problem that the crosstalk occurs between the input unit 103*a* and the output unit 103*b*.

The crosstalk occurs in the air or in the circuit board between the input unit 103*a* and the output unit 103*b*. Because of the crosstalk, a portion of the signal which is input in the amplifier circuit from the antenna element 102 via the input unit 103*a* and which is amplified is leaked to the input unit 103*a* from the output unit 103*b* and the positive feedback occurs to the circuit. In a worst situation, a standing wave is generated in the amplifier circuit, and an abnormal oscillation phenomenon in which signal strength of the particular wave length becomes strong occurs.

Therefore, closer the distance between the input unit 103*a* and the output unit 103*b* of the circuit due to the downsizing of the apparatus, greater the degree of crosstalk to the input unit 103*a* from the output unit 103*b*, and there is a problem that the generated abnormal oscillation becomes unusually strong. Further, the characteristic of the crosstalk also changes according to the wave length of the electric wave which is received by the antenna element 102. In the range of several hundred MHz which is the frequency of television, it is known that the contribution of the crosstalk which transmits in the air is greater than the contribution of the crosstalk in the circuit board.

SUMMARY OF THE INVENTION

It is, therefore, a main object of the present invention to provide an antenna apparatus capable of preventing the generation of the abnormal oscillation due to the crosstalk even when the input unit and the output unit of the amplifier circuit approximate one another by downsizing the apparatus.

According to a first aspect of the present invention, there is provided an antenna apparatus comprising an antenna element including a receiving unit to receive an electric wave, a circuit board on which an amplifier circuit to amplify an input signal inputted from the antenna element is formed, and to which an input unit for receiving the input signal from the antenna element and an output unit for an amplified signal are provided, and a shield cover which shields an interfering wave by covering the amplifier circuit on the circuit board and which is grounded, and a shielding wall to shield a crosstalk between the input unit and the output unit is formed between the input unit and the output unit of the circuit board inside the shield cover, and the shielding wall is grounded.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of an antenna apparatus according to the present invention will be described with reference to the drawings.

Figure 1A:
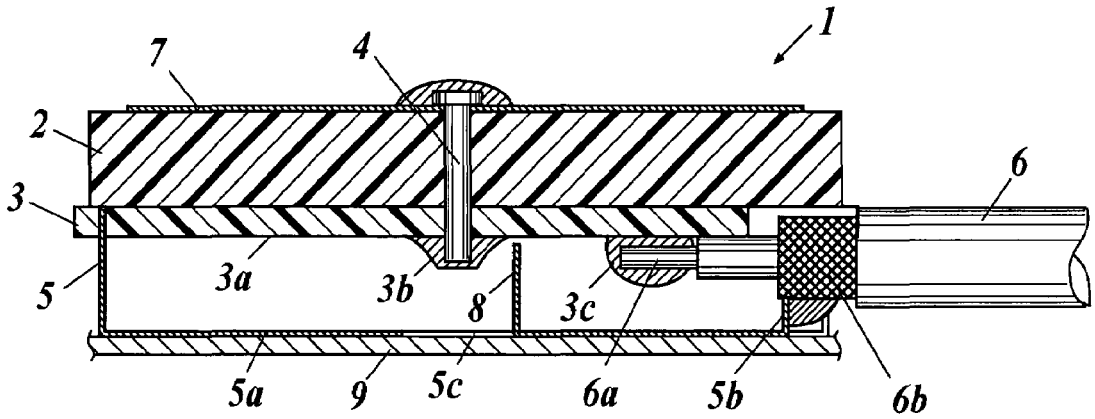
FIG. 1A is a schematic cross sectional view showing a structure of an antenna apparatus according to the embodiment in a case where there is a space between a tip of a shielding wall and a circuit board.
Figure 1B:
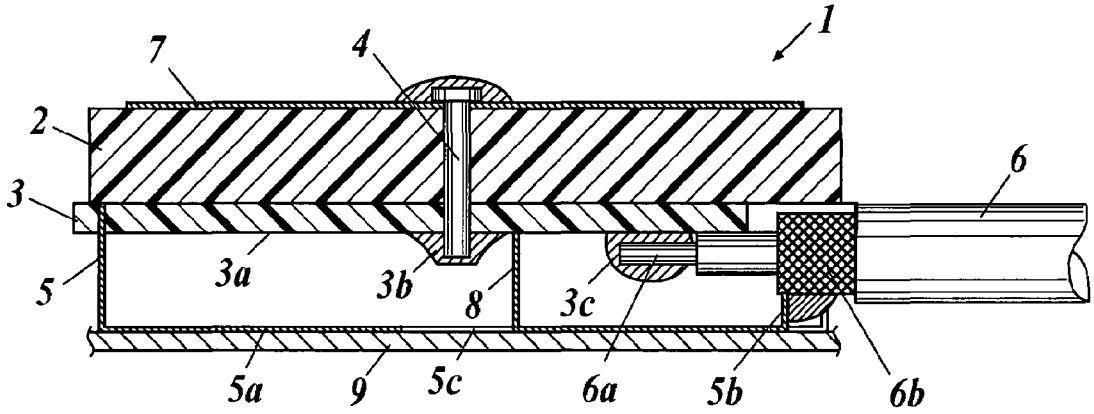
FIG. 1B is a schematic cross sectional view showing a structure of the antenna apparatus according to the embodiment in a case where the tip of the shielding wall abuts the circuit board.
Figure 2:
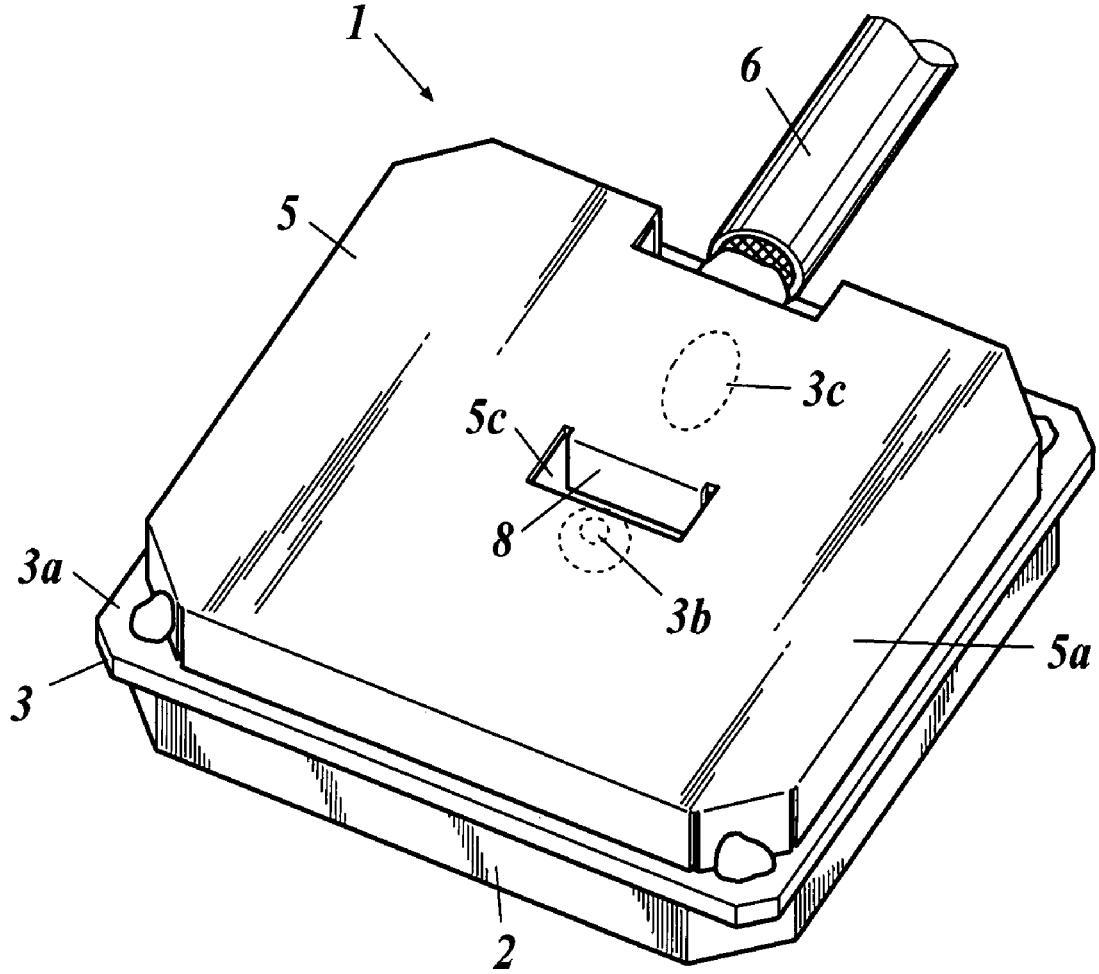
FIG. 2 is a perspective view showing a shield cover, the shielding wall and the like in a state where the antenna apparatus of FIG. 1 is top and bottom reversed.

As shown in FIGS. 1A, 1B, and 2, an antenna apparatus 1 according to the embodiment comprises an antenna element 2, a circuit board 3, an input pin 4, a shield cover 5, a coaxial cable 6 and the like. In FIG. 2, the antenna apparatus 1 is shown in a state where the top and bottom are reversed. Further, a diagram of the after-mentioned bottom cover 9 is omitted in FIG. 2.

In the embodiment, the antenna element 2 is ceramic and is formed in a slightly thick plate-like shape. On one surface side of the antenna element 2, a patch-type receiving face 7 is attached as a receiving unit which receives the electric wave. In FIGS. 1A and 1B, the receiving face 7 is expressed thicker than the actual receiving face 7. Further, the GND pattern in a metallic thin film (omitted from the drawing) is attached on approximately the entire surface which is opposite from the receiving face 7 of the antenna element 2 except for the input pin 4 and the periphery thereof.

The circuit board 3 is provided on the surface which is opposite from the receiving face 7 of the antenna element 2. The GND pattern of a metallic thin film (omitted from the drawing), which is different from the GND pattern of the antenna element 2, is attached on approximately the entire surface which is in the antenna element 2 side except for the input pin 4 and the periphery thereof.

In the embodiment, the antenna element 2 and the circuit board 3 are to be adhered to one another by the GND pattern of the circuit board 3 and the GND pattern of the antenna element 2 being attached to one another with an adhesive member such as a double-faced tape, for example. Further, in addition to the GND pattern of the antenna element 2 itself, the GND pattern of the circuit board 3 also functions as the GND pattern of the antenna element 2.

On the surface of the circuit board 3 which is the other side of the antenna element 2, i.e. the circuit face 3*a*, a circuit (omitted from the drawing) which amplifies and outputs the signal input from the antenna element 2 is formed. A plurality of through holes (omitted from the drawing) are formed at arbitrary positions on the circuit board 3, and the GND of the circuit on the circuit face 3*a* and the GND pattern on the back surface are to be connected via these through holes.

At predetermined positions of the antenna element 2 and the circuit board 3, the input pin 4 is inserted so as to be perpendicular to the receiving face 7 of the antenna element 2 and the circuit face 3*a* of the circuit board 3. In the embodiment, one end of the input pin 4 is electrically connected to the receiving face 7 of the antenna element 2 by soldering.

Moreover, the other end of the input pin 4 is soldered to the amplifier circuit on the circuit board 3 and is electrically connected thereto, and the connected part is the input unit 3*b* of the circuit. The input pin 4 inputs the electric signal which is received by the receiving face 7 of the antenna element 2 to the amplifier circuit of the circuit board 3 via the input unit 3*b*.

In the circuit face 3*a* side of the circuit board 3, the metallic shield cover 5 formed in an approximately box shape is attached so as to cover the circuit face 3*a*. The shield cover 5 shields the extraneous interfering wave reaching the circuit face 3*a*. Further, a basal face 5*a* of the approximately box shaped shield cover 5 is to be arranged in parallel to the receiving face 7 of the antenna element 2 and the circuit face 3*a* of the circuit board 3.

As shown in the cross sectional diagrams of FIGS. 1A and 1B, the position of the shield cover 5 is determined with respect to the circuit board 3 by a portion of the shield cover 5 being formed in a protruding shape and being inserted in the circuit board 3. Further, as shown in FIG. 2, the shield cover 5 is electrically connected to the GND of the circuit by being soldered on the circuit face 3*a* of the circuit board 3 in the embodiment.

The coaxial cable 6 is inserted inside the shield cover 5. the core wire 6*a* of the coaxial cable 6 is soldered to the amplifier circuit on the circuit board 3 and is electrically connected thereto, and the connected part is the output unit 3*c* of the circuit. The coaxial cable 6 supplies the driving power to the amplifier circuit via the core wire 6*a*, and also outputs the signal, which is received by the antenna element 2, is amplified by the amplifier circuit, and is output via the output unit 3*c*, to the downstream side.

A tongue 5*b* is formed to the shield cover 5 by being bent in the coaxial cable 6 side from the basal face 5*a* of the shield cover 5. The tongue 5*b* is soldered to the external conductor 6*b* of the coaxial cable 6 and is electrically connected thereto.

Moreover, a flat plate-like shielding wall 8 is formed on the inner surface of the basal face 5*a* of the shield cover 5. The shielding wall 8 is arranged so as to be in between the input unit 3*b* and the output unit 3*c* of the amplifier circuit on the circuit board 3, that is, so as to be in a condition of interrupting the straight line when the straight line connecting the input unit 3*b* and the output unit 3*c* is assumed.

As shown in FIG. 1A, the shielding wall 8 has a space between the tip of the shielding wall 8 and the circuit face 3*a* of the circuit board 3 in the embodiment. However, the tip of the shielding wall 8 may extend to the circuit board 3 and may abut the circuit face 3*a* as shown in FIG. 1B. Further, although it is not shown in the drawing, the tip of the shielding wall 8 may be soldered to the circuit board 3.

As shown in FIG. 2, the shielding wall 8 is formed by cutting a portion of the basal face 5*a* of the shield cover 5, which faces the input unit 3*b*, in a U-shape and by bending the portion toward inside the shield cover 5.

A metallic bottom cover 9 formed in an approximately flat plate-like shape is provided outside of the basal face 5*a* of the shield cover 5 so as to face-contact the basal face 5*a*. The bottom cover 9 face-contacts the basal face 5*a* of the shied cover 5, and is formed to cover the hole 5*c* of the basal face 5*a* which is opened by forming the shielding wall 8 from outside.

Here, the GND potential is supplied to the external conductor 6*b* of the coaxial cable, the shielding wall 8 is grounded via the tongue 5*b* and the shield cover 5 from the external conductor 6*b* of the coaxial cable 6 due to the aforementioned connection of the external conductor 6*b* and the tongue 5*b* of the shield cover 5, and the GND potential is supplied to the amplifier circuit of the circuit board 3 and the antenna element 2.

Moreover, in the embodiment, the grounding efficiencies of the shielding wall 8, the amplifier circuit, and the antenna element 2 via the shield cover 5 are improved by the metallic bottom cover 9 face-contacting with the basal face 5*a* of the shield cover 5 as described above.

Next, an operation of the antenna apparatus 1 according to the embodiment will be described.

The driving power is supplied to the amplifier circuit on the circuit board 3 of the antenna apparatus 1 via the output unit 3*c* from the core wire 6*a* of the coaxial cable 6. Further, when the receiving face 7 of the antenna element 2 receives the high frequency electric wave for the GPS and for the satellite radio, the electric wave signal is transmitted to the amplifier circuit via the input unit 3*b*. Then, the electric wave signal which is amplified by the amplifier circuit is output through the core wire 6*a* of the coaxial cable 6 from the output unit 3*c*.

The amplifier circuit of the circuit board 3 is shielded from the extraneous interfering wave by the metallic shield cover 5 which covers the amplifier circuit of the circuit board 3. Further, the GND of the amplifier circuit is connected to the shied cover 5 as described above, and the amplifier circuit is grounded by the GND potential being supplied to the shield cover 5 from the external conductor 6*b* of the coaxial cable 6. The GND potential is also supplied to the GND pattern of the circuit board 3 via the through holes of the circuit board 3. Then, the GND pattern of the circuit board 3 is grounded and the GND level is provided to the antenna element 2.

Moreover, in the embodiment, the grounding efficiency of the shield cover 5 is improved by the metallic bottom cover 9, which is provided at the bottom of the antenna apparatus 1, face-contacting the basal face 5*a* of the shield cover 5, and the grounding efficiency of the amplifier circuit is even more improved.

Meanwhile, as described above, when the input unit 3*b* and the output unit 3*c* of the amplifier circuit approximate one another as in the case of the antenna apparatus 1 of the embodiment, the crosstalk in which a portion of the signal leaks to the input unit 3*b* from the output unit 3*c* occurs and the standing wave is generated in the amplifier circuit. As a result, the abnormal oscillation phenomenon occurs.

However, in the embodiment, because the shielding wall 8 is provided between the input unit 3*b* and the output unit 3*c* of the circuit and is grounded, the signal which leaks in the air inside the shield cover 5 among the leaked signal is absorbed by the shielding wall 8 on the way to the input unit 3*b* even when a portion of the signal leaks from the output unit 3*c*. Then, the signal flows into the external conductor 6*b* of the coaxial cable 6 and the bottom cover 9 via the shield cover 5. Therefore, al least concerning the leaked signal which transmits in the air, the leaked signal does not flow back into the input unit 3*b* or the back-flow of the leaked signal into the input unit 3*b* is inhibited.

Moreover, the effect of shielding the leaked signal can be obtained sufficiently even when there is a space between the tip of the shielding wall 8 and the circuit board 3 as shown in FIG. 1A. However, the greater the degree of shielding the space inside the shield cover 5 by the shielding wall 8 becomes, the greater the effect of shielding the crosstalk becomes. Therefore, when the tip of the shielding wall 8 abuts the circuit board 3 as shown in FIG. 1B or when the tip of the shielding wall 8 is soldered to the circuit board 3, the degree of inhibition of the back-flow of the leaked signal into the input unit 3*b* becomes greater concerning the leaked signal which transmits in the air.

Furthermore, because the shielding wall 8 is soldered to the circuit board 3, the signal which leaks by transmitting inside the circuit board 3 is absorbed by the shielding wall 8 via the soldered part on the way to the input unit 3*b*. Therefore, the leaked signal does not flow back into the input unit 3*b* or the back-flow of the leaked signal into the input unit 3*b* can be inhibited concerning the leaked signal which transmits in the board.

As described above, according to the antenna apparatus 1 of the embodiment, because the shielding wall 8 is provided between the input unit 3*b* and the output unit 3*c* of the amplifier circuit on the circuit board 3 and is grounded, the shielding wall 8 shields and absorbs the signal which leaks by transmitting in the air inside the shield cover 5 among the signal which leaks from the output unit 3*c*. Therefore, the leaked signal does not flow back into the input unit 3*b* or the back-flow of the leaked signal into the input unit 3*b* is inhibited concerning at least the leaked signal which transmits in the air.

In such way, the positive feedback to the input unit 3*b* of the circuit is prevented or inhibited and the generation of the standing wave in the circuit is prevented or reduced, and then the occurrence of the abnormal oscillation due to the crosstalk is prevented or is repressed to the level where there is no practical problem. Therefore, the degradation of the isolation of the signal input/output can be prevented even in a state where the input unit 3*b* and the output unit 3*c* of the amplifier circuit approximate one another due to the downsizing of the antenna apparatus. Accordingly, the occurrence of the abnormal oscillation due to the crosstalk can be virtually prevented.

Moreover, as long as the tip of the shielding wall 8 is soldered to the circuit board 3 as in the embodiment, the degree of shielding of the space inside the shield cover 5 by the shielding wall 8 becomes greater. Accordingly, the effect of inhibiting the leaked signal which transmits in the air from flowing back into the input unit 3*b* can be even greater.

Because the signal which leaks by transmitting inside the circuit board 3 is absorbed by the shielding wall 8 via the soldered part on the way to the input unit 3*b*, the leaked signal does not flow back into the input unit 3*b* or the back-flow of the leaked signal into the input unit 3*b* can be inhibited concerning the leaked signal which transmits in the board. Here, there is an effect that the structural strength of the shield cover 5 will be improved by soldering the tip of the shielding wall 8 to the circuit board 3.

Meanwhile, as in the embodiment, the shielding wall 8 can be provided easily and appropriately by forming the shielding wall 8 by cutting a portion of the basal face 5*a* of the shield cover 5 which faces the input unit 3*b* in a U-shape and by bending the portion toward inside the shield cover 5. When the shielding wall 8 is formed, the hole 5*c* is opened in the part which faces the input unit 3*b* of the shield cover 5. However, the soldered part of the input pin 4 and the wiring of the amplifier circuit at the input unit 3*b* can be visually confirmed via the hole 5*c*, and a manufacturing worker or a user of the antenna apparatus 1 can easily confirm whether the soldering at the input unit 3*b* exist or not or whether the soldering at the input unit 3*b* is good or bad.

Moreover, there is a case where the degree of shielding of the interfering wave by the shield cover 5 is degraded by the opening of the hole 5*c*. However, the degree of shielding of the interfering wave can be maintained sufficiently by covering the hole 5*c* with the metallic bottom cover 9 from outside of the shield cover 5 as in the embodiment.

Here, instead of covering the hole 5*c* with the metallic bottom cover 9, the hole 5*c* may be covered with a metallic tape such as a copper tape which is removable from the shield cover 5. Alternatively, the degree of shielding the interfering wave can be similarly maintained when a metallic tape is attached to the part corresponding to the hole 5*c* of the bottom cover 9 which is made of resin, for example.

Figure 3A:
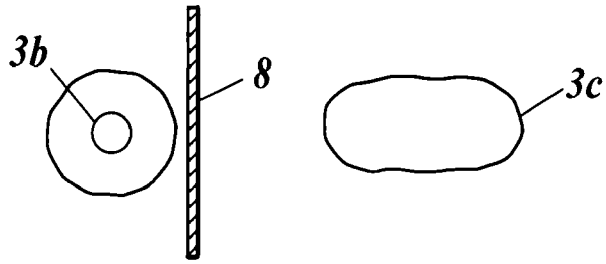
FIG. 3A is a diagram showing a shape of the shielding wall in a case of the embodiment.
Figure 3B:
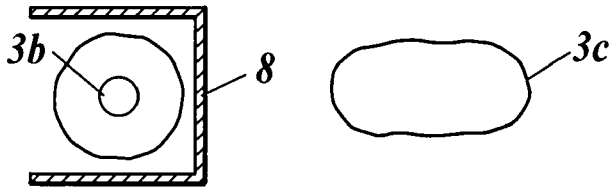
FIG. 3B is a diagram showing a shape of the shielding wall in a case where a portion of a periphery of an input unit is encircled.

When the antenna apparatus 1 of FIG. 2 is seen from above, a description is given for the case where the shielding wall 8 is arranged between the input unit 3*b* and the output unit 3*c* of the circuit in a form of a flat plate-like shape as shown in the diagram of FIG. 3A in the embodiment. However, alternatively, the shielding wall 8 may be formed so as to encircle a portion of the periphery of the input unit 3*b* as shown in FIG. 3B, for example. Further, the shielding wall 8 may be formed so as to encircle the entire periphery of the input unit 3*b* as shown in FIG. 3C.

Instead of having the shielding wall 8 encircle the entire or a portion of the periphery of the input unit 3*b* of the circuit or in addition to the encircling of the input unit 3*b* by the shielding wall 8, the shielding wall 8 can be formed so as to encircle the entire or a portion of the periphery of the output unit 3*c*.

In such way, by the shielding wall 8 encircling the entire or a portion of the periphery of the input unit 3*b* or the output unit 3*c* of the circuit, the signal which leaks by transmitting in the air inside the shield cover 5 or the signal which leaks by transmitting inside the circuit board 3 can be shielded more surely. Accordingly, leakage of the signal into the input unit 3*b* can be prevented or inhibited more accurately.

Figure 3C:
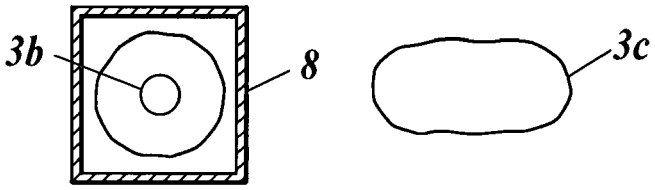
FIG. 3C is a diagram showing a shape of the shielding wall in a case where an entire periphery of the input unit is encircled.
Figure 4:
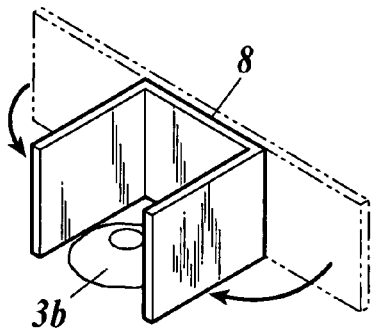
FIG. 4 is a schematic perspective view showing the shielding wall in which both ends are bent furthermore.
Figure 5:
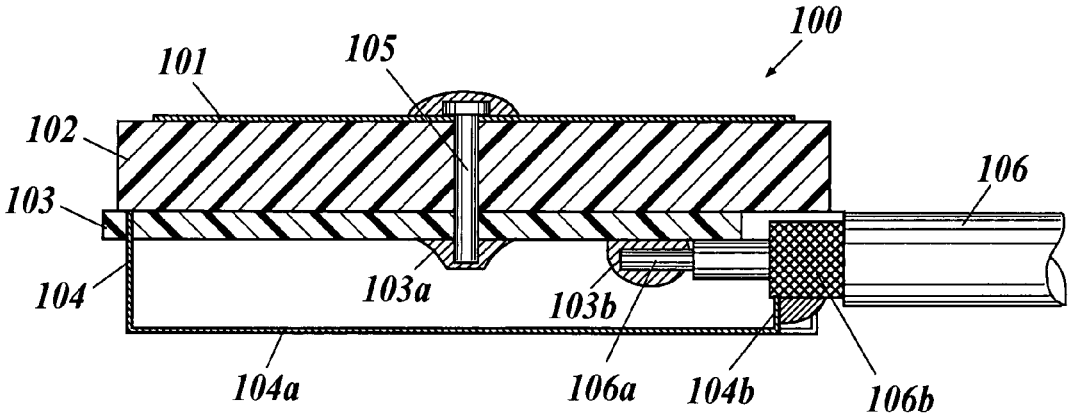
FIG. 5 is a schematic cross sectional view showing a structure of a conventional antenna apparatus.

For example, when the shielding wall 8 is formed by bending a portion of the shield cover 5 toward inside as in the embodiment, as shown in FIG. 4, the shielding wall 8 which encircles the entire or a portion of the periphery of the input unit 3*b* or the output unit 3*c* as shown in FIGS. 3B and 3C can be formed by bending the both ends of the shielding wall 8 which is formed by bending as shown in FIG. 3A, in the input unit 3*b* side or the output unit 3*c* side.

In FIGS. 3 and 4, a description is given for the case where each surface of the shielding wall 8 which encircles the input unit 3*b* or the output unit 3*c* is formed in a flat plate-like shape. However, the shielding wall 8 may be formed so that each surface thereof is shaped in a curved surface, and also, the shielding wall 8 may be formed in a tubular shape or in a partial tubular shape which has a circular cross-sectional shape, an elliptical cross-sectional shape or the like.

Moreover, instead of forming the shielding wall 8 by bending a portion of the shield cover 5 toward inside, the shielding wall 8 may be provided by attaching a metallic piece formed in a flat plate-like shape, a tubular shape or the like at an appropriate position on the inner surface of the shield cover 5 by adhesion or the like. Contrary, the shielding wall 8 may be provided so as to project in the shield cover 5 side from the circuit board 3 side in a state where the shielding wall 8 is connected to the GND pattern of the antenna element 2 via the through holes of the circuit board 3 and is grounded.

Furthermore, the antenna apparatus 1 comprising the patch-type receiving face 7, which receives a high frequency electric wave for the GPS or the satellite radio, on the front surface of the antenna element 2 is described in the embodiment. However, the structure of the antenna element is not limited to the structure in which the patch-type receiving face is provided.

According to a first aspect of the preferred embodiment of the present invention, there is provided an antenna apparatus comprising a receiving unit to receive an electric wave, a circuit board on which an amplifier circuit to amplify an input signal inputted from the antenna element is formed, and to which an input unit for receiving the input signal from the antenna element and an output unit for an amplified signal are provided, and a shield cover which shields an interfering wave by covering the amplifier circuit on the circuit board and which is grounded, and a shielding wall to shield a crosstalk between the input unit and the output unit is formed between the input unit and the output unit of the circuit board inside the shield cover, and the shielding wall is grounded.

In accordance with the first aspect of the preferred embodiment of the present invention, because the shielding wall is provided between the input unit and the output unit of the amplifier circuit on the circuit board and is grounded, the shielding wall shields and absorbs at least the signal which leaks by transmitting in the air inside the shield cover among the signal leaked from the output unit. Therefore, the leaked signal which transmits in the air does not flow back in the input unit, or the back-flow of the leaked signal to the input unit is prevented.

In such way, the positive feedback to the input unit from the output unit of the circuit is prevented or inhibited and the generation of the standing wave in the circuit is prevented or reduced. Accordingly, the occurrence of the abnormal oscillation due to the crosstalk is prevented or is repressed to the level where there is no practical problem. Therefore, degradation of the isolation of the signal input/output can be prevented even in a state where the input unit and the output unit of the amplifier circuit approximate one another by downsizing the antenna apparatus. Accordingly, the occurrence of the abnormal oscillation due to the crosstalk can be virtually prevented.

Preferably, the shielding wall is formed on an inner surface of the shield cover.

Accordingly, the same effect can be obtained. Further, the shielding wall can be formed easily and surely by forming the shielding wall on the inner surface of the shield cover at the time of manufacturing the shield cover.

Preferably, the shielding wall is formed by bending a portion of the shield cover toward inside the shield cover.

Accordingly, by forming the shielding wall by bending a portion of the shield cover toward inside the shield cover, the shielding wall can be formed easily and accurately. Further, the soldered part of the input pin and the wiring of the amplifier circuit at the input unit can be visually confirmed via the hole which was formed in the shield cover in order to form the shielding wall. Therefore, in addition to the above described effects of the preferred embodiment of the present invention, a manufacturing worker and a user of the antenna apparatus can easily confirm whether the soldering of the input unit exists or not or whether the soldering of the input unit is good or bad.

Preferably, an end portion of the shielding wall in a side of the circuit board is soldered to the circuit board.

Accordingly, by soldering the end of the shielding wall in the circuit board side to the circuit board, the degree of shielding of the space inside the shield cover by the shielding wall becomes greater and the inhibitory effect on the leaked signal which transmits in the air flowing back in the input unit can be even greater. Further, because the signal which leaks by transmitting inside the circuit board is absorbed by the shielding wall via the soldered part on the way to the input unit, the leaked signal which transmits in the board also does not flow back in the input unit or the back-flow of the leaked signal to the input unit can be inhibited. Therefore, the above mentioned effects of the preferred embodiment of the present invention are realized more effectively, and the structural strength of the shield cover itself is improved due to soldering of the shielding wall.

Preferably, the shielding wall is formed so as to encircle an entire periphery of the input unit, a portion of the periphery of the input unit, an entire periphery of the output unit, or a portion of the periphery of the output unit.

Accordingly, by forming the shielding wall so as to encircle the entire or a portion of the periphery of the input unit or the output unit, the signal which leaks by transmitting in the air inside the shield cover or the signal which leaks by transmitting inside the circuit board can be shielded more surely, and the above mentioned effects of the preferred embodiment of the present invention can be realized more effectively.

The entire disclosure of Japanese Patent Application No. 2006-252312 filed on Sep. 19, 2006 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An antenna apparatus, comprising:

an antenna element including a receiving unit to receive an electric wave;

a circuit board on which an amplifier circuit to amplify an input signal inputted from the antenna element is formed, and to which an input unit for receiving the input signal from the antenna element and an output unit for outputting an amplified signal are provided;

a shield cover which shields an interfering wave by covering the amplifier circuit on the circuit board, and which is grounded; and a shielding wall which is provided inside the shield cover between the input unit and the output unit of the circuit board to shield crosstalk between the input unit and the output unit, and which is grounded;

wherein the shielding wall is formed by bending a portion of the shield cover toward inside the shield cover.

2. The antenna apparatus as claimed in claim 1, wherein the shielding wall is formed on an inner surface of the shield cover.

3. The antenna apparatus as claimed in claim 1, wherein an end portion of the shielding wall adjacent to the circuit board is soldered to the circuit board.

4. The antenna apparatus as claimed in claim 1, wherein the shielding wall is formed so as to encircle at least a portion of a periphery of the input unit.

5. The antenna apparatus as claimed in claim 4, wherein the shielding wall is formed so as to encircle an entirety of the periphery of the input unit.

6. The antenna apparatus as claimed in claim 1, wherein the shielding wall is formed so as to encircle at least a portion of a periphery of the output unit.

7. The antenna apparatus as claimed in claim 6, wherein the shielding wall is formed so as to encircle an entirety of the periphery of the output unit.

* * * * *